US006116265A

United States Patent [19]

Drake

[11] Patent Number: 6,116,265

[45] Date of Patent: Sep. 12, 2000

[54] REMOVABLE FROST PROOF HYDRANT

[76] Inventor: Walter R. Drake, 6990 Dobson, Jonesville, Mich. 49250

[21] Appl. No.: 09/447,732

[22] Filed: Nov. 23, 1999

[51] Int. Cl.[7] ..... E03B 9/02

[52] U.S. Cl. ..... 137/301; 137/322; 137/329.4; 239/273; 239/569; 251/149.4

[58] Field of Search ..... 137/301, 302, 137/321, 322, 329.2, 329.3, 329.4, 801; 239/204, 207, 273, 276, 285, 570, 571, 569; 251/149.4, 149.5, 149.6

[56] References Cited

U.S. PATENT DOCUMENTS

| | | | |
|---|---|---|---|
| 108,824 | 11/1870 | Putnam, Jr. | 137/322 |
| 179,092 | 6/1876 | Booth et al. | 137/322 |
| 182,603 | 9/1876 | Rich | 137/329.2 |
| 629,304 | 7/1899 | Rawlins | 137/322 |
| 797,384 | 8/1905 | Thurston | 137/322 |
| 1,221,276 | 4/1917 | Bolander | 251/149.6 |
| 1,855,264 | 4/1932 | Thompson | 239/569 |
| 1,875,679 | 9/1932 | Thompson | 239/569 |
| 1,875,780 | 9/1932 | Thompson | 239/569 |
| 2,033,880 | 3/1936 | Coles et al. | 137/322 |
| 2,076,805 | 4/1937 | Wine | 137/329.2 |
| 2,278,580 | 4/1942 | Coles et al. | 137/329.4 |
| 2,310,485 | 2/1943 | Wyckoff | 137/329.4 |
| 2,829,907 | 4/1958 | Gill | 251/149.5 |
| 2,919,146 | 12/1959 | Gill | 251/149.8 |
| 3,494,373 | 2/1970 | Horak et al. | 137/322 |
| 3,533,435 | 10/1970 | Uys | 137/322 |
| 4,072,271 | 2/1978 | Voss et al. | 239/541 |
| 4,298,166 | 11/1981 | White et al. | 239/24 |
| 4,848,661 | 7/1989 | Palmer et al. | 239/204 |
| 5,110,157 | 5/1992 | Chen | 285/8 |
| 5,143,346 | 9/1992 | Chen | 251/149.5 |
| 5,261,441 | 11/1993 | Anderson | 137/281 |
| 5,289,840 | 3/1994 | Anderson | 137/302 |
| 5,344,119 | 9/1994 | Wang | 251/149.1 |
| 5,628,492 | 5/1997 | Lee | 251/149.1 |
| 5,911,404 | 6/1999 | Cheng | 251/149.6 |

FOREIGN PATENT DOCUMENTS

| | | | |
|---|---|---|---|
| 663773 | 8/1929 | France | 137/329.4 |

*Primary Examiner*—George L. Walton
*Attorney, Agent, or Firm*—Young & Basile, P.C.

[57] ABSTRACT

A freeze-proof hydrant has a hollow, tubular housing adapted to be buried in the ground in a vertical orientation so that its upper end is approximately even with the surface of the ground and its lower end is below the local frost line. A base fitting at the lower end of the housing is connected to an underground pipe and has an internal shut-off valve for controlling the flow of water out of the underground pipe. The lower end of a removable standpipe has a threaded fitting which mates with the base fitting in a manner that opens the shut-off valve when the standpipe is screwed into connection with the base fitting. The standpipe projects upwardly through the housing to a point above ground level and terminates in a faucet. When the standpipe is inserted downwardly into the housing and screwed into connection with the base fitting, the shut-off valve in the base fitting automatically opens so that water flows upwardly into the standpipe and the faucet may be operated to deliver water as desired. To winterize the hydrant, the standpipe is unscrewed from the base fitting and removed from the housing. Unscrewing the stand pipe from the base fitting closes the shut-off valve, and the standpipe is then withdrawn upwardly out of the housing and either drained and stored or moved to a hydrant at a different location.

4 Claims, 2 Drawing Sheets

FIG-1
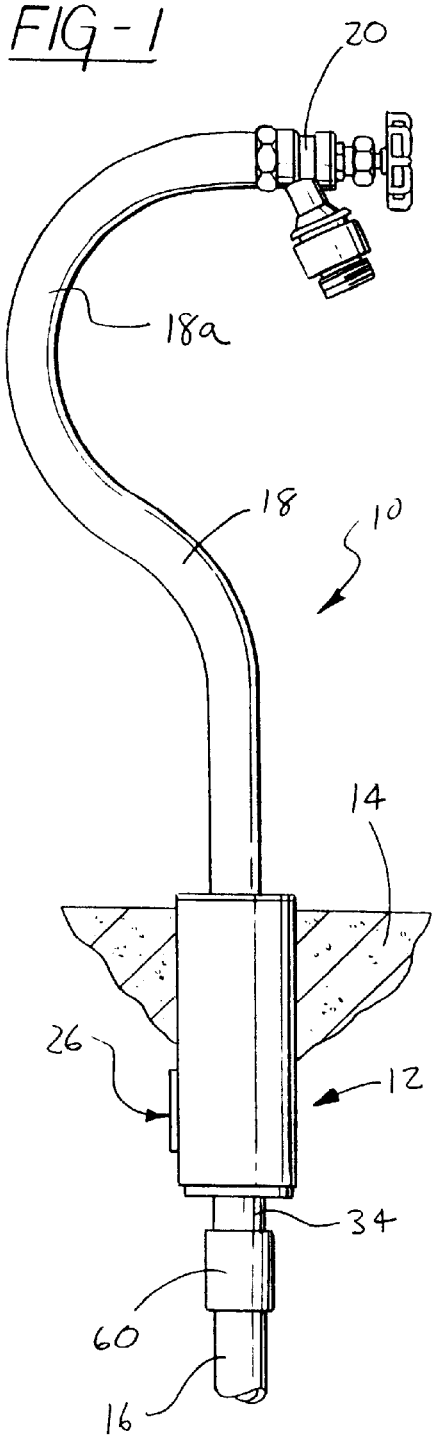
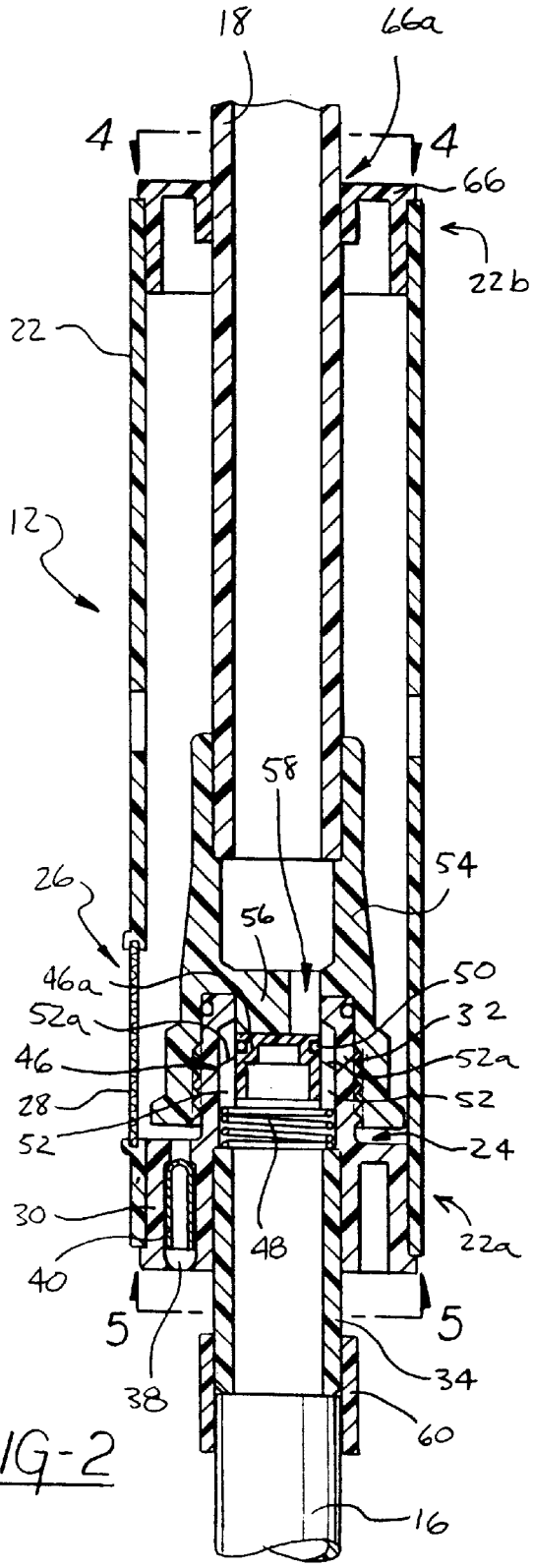
FIG-2

FIG-3
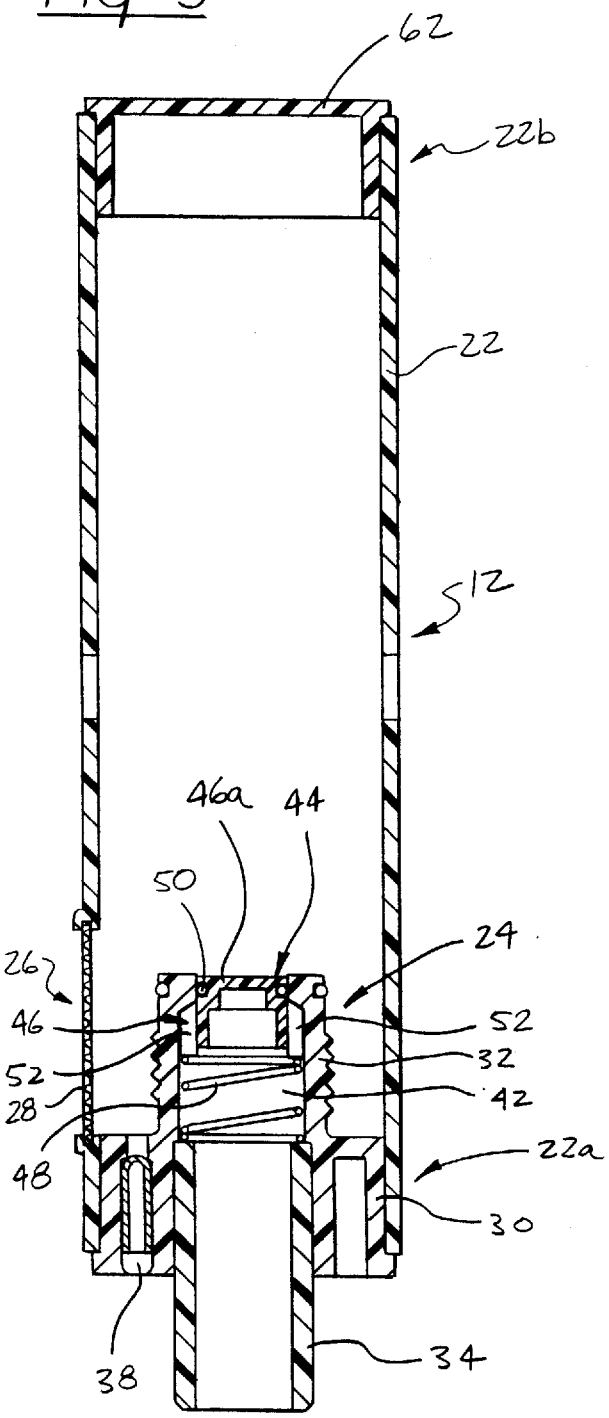
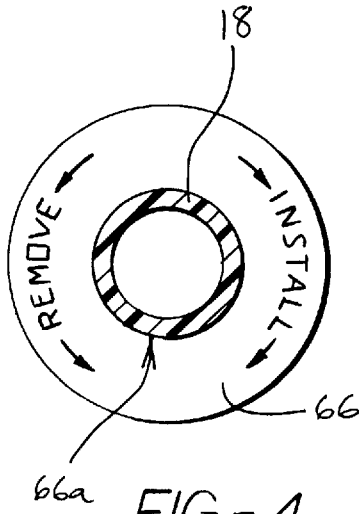
FIG-4
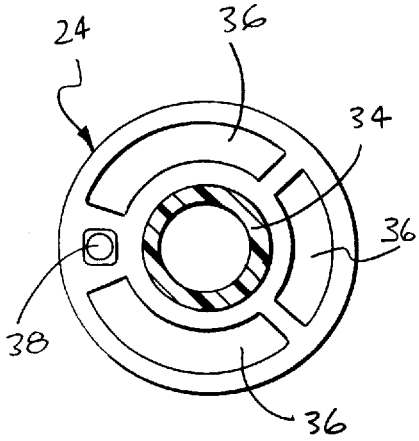
FIG-5

REMOVABLE FROST PROOF HYDRANT

FIELD OF THE INVENTION

This invention relates to an in-ground hydrant which is resistant to freezing during cold weather and whose superstructure is removable.

BACKGROUND OF THE INVENTION

It is often desirable to have an underground plumbing system to supply water to one or more outdoor locations for irrigation or other purposes. In geographic areas where temperatures remain below freezing for extended periods of time in the winter, an underground plumbing system must be either drained of water at the onset of winter weather or buried below the frost line, the depth below the surface to which the earth is expected to freeze. Even if nearly all of the plumbing system is buried below the frost line, the points at which the system delivers water to the surface, such as faucets or sprinklers, must be drained to prevent the water in these components from freezing and damaging the pipes or fittings.

Conventional frostproof hydrants include a standpipe extending above the ground surface having a valve located below the frost line, and a valve operator at the upper end of the standpipe controls the position of the valve. The problem with such conventional frostproof hydrants is that a rather unsightly standpipe is always visible, and with present frostproof hydrants no system exists wherein the standpipe may be removed from view and yet the frostproof characteristics maintained, and yet the standpipe may be easily reconnected to the water system, even during freezing conditions.

SUMMARY OF THE INVENTION

It is an objective of this invention to provide a freeze-resistant hydrant for use in conjunction with an underground plumbing system. It is a further objective of the invention to provide a hydrant in which the water delivery portion extending above the frost line may be easily removed and either drained for winter storage or moved to another hydrant at a different location.

In carrying out the invention in the illustrative embodiment thereof, the hydrant comprises a hollow, tubular housing adapted to be buried in the ground in a vertical orientation so that its upper end is approximately even with the surface of the ground and its lower end is below the local frost line. A base fitting at the lower end of the housing has an inlet end connected to an underground pipe and an integral shut-off valve for controlling the flow of water out of the underground pipe. The shut-off valve is biased to a closed position.

The lower end of a removable standpipe has a threaded fitting which mates with the base fitting in a manner that opens the shut-off valve when the standpipe is screwed into connection with the base fitting. The standpipe projects upwardly through the upper end of the housing to a point above ground level and terminates in a faucet or other manually operated valve.

To operate the hydrant, the standpipe is inserted downwardly into the housing and the end fitting is screwed into connection with the base fitting. This connection opens the shut-off valve in the base fitting so that water from the underground pipe flows upwardly into the standpipe and the faucet may be operated to deliver water as desired. When the hydrant is not in use, the faucet is turned off and the standpipe is disconnected from the base fitting and removed from the housing. Disconnecting the stand pipe from the base fitting allows the shut-off valve to return to the closed position, and the standpipe is then pulled upwardly out of the housing and either drained for storage or moved to a hydrant at a different location and connected for use.

In the preferred embodiment of the invention, the shut-off valve comprises a movable plunger retained within a chamber inside the base fitting and a coil spring biasing the plunger upwardly to the closed position. The end fitting of the standpipe has a projection which urges the plunger downwardly to the open position when the standpipe is screwed into mating engagement with the base fitting.

The invention hydrant is preferably supplied with two alternate end caps for the upper end of the housing. A first end cap has a central hole through which the standpipe passes when it is in its operating position, thus keeping the standpipe centered in the housing and providing horizontal support to the standpipe. The second cap is solid and completely closes the upper end of the housing at or slightly above ground level when the standpipe is removed.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 1 is an elevation view of a hydrant according to the present invention installed in the ground;

FIG. 2 is a cross-sectional view of the lower portion of the invention hydrant with the standpipe connected and the valve in the open position;

FIG. 3 is a cross-sectional view of the invention hydrant in a winterized condition;

FIG. 4 is a view taken along line 4—4 of FIG. 2; and

FIG. 5 is a view taken along line 5—5 of FIG. 2.

DESCRIPTION OF THE PREFERRED EMBODIMENT

As seen in FIG. 1, a freeze-proof hydrant 10 according to the present invention generally comprises a lower portion 12 buried in the earth 14 and connected to an underground water supply pipe 16, and a standpipe 18 extending upwardly from the lower portion and having a manually actuated valve such as a faucet 20 at its upper end. As described in greater detail hereinbelow, the standpipe 18 may be disconnected and removed from the lower portion 12 in order to winterize the hydrant 10 and/or to move the standpipe 18 to a second hydrant (not shown) at a different location.

As best seen in FIG. 3, the lower portion 12 comprises a tubular housing 22 and a base fitting 24 disposed at a lower end 22*a* of the housing. The housing 22 is long enough that when the upper end 22*b* is just above the surface of the ground the base fitting 24 extends deep enough below the surface to be below the frost line in the particular geographical area. The housing 22 may be produced in a variety of different lengths for areas having frost lines located at different depths. Both the housing 22 and base fitting 24 are preferably fabricated from a plastic material such as polyvinyl chloride (PVC) so as to be impervious to corrosion. A vent hole 26 passes through the housing 22 adjacent its lower end 22*a* and a small perforated plate or screen 28 is retained in the hole.

The base fitting 24 comprises a plug section 30 which fits snugly into the lower end 22*a* of the housing 22, a threaded male section 32 projecting upwardly into the interior of the housing 22, and a lower connection nipple 34 retained in a recess formed in the center of the plug section 30. In the preferred embodiment shown, three annular voids 36 (see FIG. 5) are formed in the lower surface of the plug section 30 around the central recess to reduce the amount of material required to form the base fitting 24. The base fitting 24 is preferably solvent glued or spin welded to secure it in place within the housing 22. A drain hole 38 is formed vertically through the plug section 30 outboard of the upper male section 32, and may be fitted with a vinyl cap 40 during shipping.

The hollow interior of the male section 32 of the base fitting 24 defines a valve chamber 42, and an orifice 44 connects the chamber to the interior of the housing 22. A valve plunger 46 is disposed in the valve chamber 42, and a coil spring 48 is seated on the upper end of the connection nipple 34 and urges the plunger 46 upwardly. The valve plunger 46 is preferably formed of PVC.

A main body 46*a* of the plunger 46 is of a slightly smaller diameter than the orifice 44 and an O-ring 50 is nested in a groove surrounding the plunger 46 to provide a water-tight seal. Three or more radial fins 52 extend outward from the main body 46*a* and have beveled upper ends 52*a* (see FIG. 2) which match the angle of the bevel at the transition between the valve chamber 42 and the orifice 44. Accordingly, the spring 48 urges the plunger 46 to the position shown in FIG. 3 wherein the plunger 46 blocks and seals the orifice 44.

The lower end of the standpipe 18 terminates in an end fitting 54 having a female threaded receptacle which mates with the male section 32 of the base fitting 24. As seen in FIG. 2, a valve operating member in the form of a finger 56 projects downwardly within the female receptacle adjacent one side thereof, while a flow passage 58 is present on the other side of the fitting 54. The faucet 20 at the upper end of the standpipe 18 is preferably a standard, off-the-shelf component intended for outdoor use, however it may be replaced by any desired type of fitting, nozzle, or sprinkler depending on the intended use of the hydrant 10. In the preferred embodiment, the standpipe 18 has a C-shaped curve 18*a* adjacent its upper end so that it is easier to twist the standpipe 18 about the vertical axis when connecting or disconnecting the standpipe 18 from the lower portion 12 of the hydrant.

The lower portion 12 of the hydrant 10 is permanently buried in the ground in a hole of the proper size, and the connection nipple 34 is permanently connected to the underground water pipe 16, for example by means of a sleeve fitting 60 or a threaded coupling. When the hydrant 10 is not being used a solid end cap 62, as seen in FIG. 3, fits tightly into the upper end of the housing 22 to prevent water or other debris from entering the housing 22. When it is desired to use the hydrant 10, the solid cap 62 is removed and the standpipe 18 is inserted downwardly into the housing 22 and rotated to screw the end fitting 54 into mating threaded engagement with the base fitting 24. A pipe support cap 66 has a central hole 66*a* through which the standpipe 18 projects, and the cap 66 is slid downwardly around the standpipe 18 and into the upper end 22*b* of the housing. The pipe support cap 66, in addition to keeping debris out of the housing 22, provides radial support for the standpipe 18 and restrains it against horizontal deflection.

As the end fitting 54 is screwed downward onto the base fitting 24, the finger 56 comes into contact with the top of the valve plunger 46 and urges the plunger downwardly against the force of the coil spring 48. When the end fitting 54 is fully engaged with the base fitting 24 (see FIG. 2), the finger 56 projects downwardly through the orifice 44, holding the valve plunger 46 downwardly to unplug the orifice 44 so that water from the underground pipe 16 is able to flow upwardly through the connection nipple 34, passing around the outside of the valve plunger 46 in the spaces between the radial fins 52, and through the flow passage 58 into the standpipe 18. The water may now be turned on and off at will using the faucet 20 at the top of the standpipe 18.

The hydrant 10 is winterized by unscrewing the standpipe 18 from its threaded engagement with the base fitting 24 and pulling the standpipe 18 upwardly out of the housing 22. As the end fitting 54 is unscrewed from the base fitting 24, the finger 56 is withdrawn from the orifice 44 and the spring 48 urges the valve plunger 46 upwardly to the closed position wherein the flow of water through the base fitting 24 is shut off. Any water remaining in the standpipe 18 when it is disconnected from the base fitting 24 drains downwardly into the housing 22, where it is able to seep out into the ground through the vent hole 26 and/of the drain hole 38. As the standpipe 18 is pulled upwardly, the end fitting 54 pulls the pipe support cap 66 out of the upper end 22*b* of the housing, the cap remaining around the standpipe 18. The solid cap 62 is pushed downward into the upper end of the housing 22 to seal against the entry of any debris. The standpipe 18 may then be either stored or carried to and connected with a second hydrant for use.

In the winterized condition, the invention hydrant 10 is not subject to freezing during cold weather, since the base fitting 24 is below the frost line. The invention hydrant 10 may be used in freezing conditions as long as the standpipe 18 is disconnected, removed from the housing 22 and drained soon enough after the faucet 20 is shut off that water remaining in the standpipe 18 does not freeze.

The invention hydrant may be provided in a variety of lengths for use in various geographic areas depending on the depth of the frost line below the ground surface. The invention hydrant also provides a aesthetically pleasing hydrant installation in that the standpipe 18 may be removed when it is not in use so that the hydrant is all but invisible, only the top inch or two of the housing 22 projecting above the ground surface.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

The invention claimed is:

1. A freeze-resistant hydrant for mounting in a hole in the ground and connectable to an underground water pipe, the hydrant comprising:

a hollow tubular housing of such a length that, when said housing is disposed in the hole, an upper end of said housing is adjacent the ground surface and a lower end of said housing is below a frost line;

a base fitting disposed adjacent the lower end of said housing and having a lower end connectable to the water pipe;

a stand pipe having an upper outlet end and a lower inlet end;

a manually actuated valve disposed at said outlet end of said stand pipe;

an end fitting disposed at said inlet end of said stand pipe and removably connectable with an upper end of said base fitting such that said stand pipe extends upwardly through said housing to position the manually actuated valve above ground level;

a valve operator finger directly defined on said stand pipe end fitting; and a base fitting valve disposed within said base fitting and having a plunger biased to a closed position to block the flow of water upwardly into said stand pipe from the underground pipe, said plunger being directly engaged by said valve operator finger actuable to an open condition wherein water may flow upwardly into said stand pipe by connecting said stand pipe end fitting to said base fitting.

2. The hydrant according to claim 1 wherein said plunger is biased to the closed condition by a spring.

3. The hydrant according to claim 1 further comprising a cap securable to said upper end of said housing and having a central hole through which said stand pipe passes.

4. The hydrant according to claim 1 wherein said upper end of said base fitting is threaded and said stand pipe end fitting is complementarily threaded to facilitate removable connection between said base fitting and said stand pipe end fitting.

* * * * *